US005343817A

United States Patent [19]

Abraham et al.

[11] Patent Number: 5,343,817

[45] Date of Patent: Sep. 6, 1994

[54] PORTABLE PODIUM AND PERFORMANCE PLATFORM SYSTEM

[75] Inventors: Leslie R. Abraham; John H. Kniefel, both of Owatonna, Minn.

[73] Assignee: Wenger Corporation, Owatonna, Minn.

[21] Appl. No.: 955,280

[22] Filed: Oct. 1, 1992

Related U.S. Application Data

[63] Continuation-in-part of Ser. No. 790,214, Nov. 7, 1991.

[51] Int. Cl.[5] ..... A47B 57/00

[52] U.S. Cl. ..... 108/97; 52/7

[58] Field of Search ..... 52/64, 67, 9, 7, 143, 52/795; 108/97, 92, 98, 64, 53.5, 11, 13

[56] References Cited

U.S. PATENT DOCUMENTS

| | | | |
|---|---|---|---|
| 2,633,996 | 4/1953 | Litchfield | 108/97 X |
| 2,940,804 | 6/1960 | Bullock | 108/97 X |
| 3,335,532 | 8/1967 | Greenbie | 52/143 X |
| 3,747,708 | 7/1973 | Wenger et al. | 52/9 |
| 3,984,949 | 10/1976 | Wahlquist | 52/143 X |
| 4,467,569 | 8/1984 | Blanchard et al. | 52/9 |
| 4,478,467 | 10/1984 | Tyndall | 52/79.5 X |
| 4,912,887 | 4/1990 | Sullivan | 52/7 |
| 4,934,113 | 6/1990 | Hall et al. | 52/7 |

FOREIGN PATENT DOCUMENTS

| | | | |
|---|---|---|---|
| 753000 | 2/1967 | Canada | 52/7 |

*Primary Examiner*—Jose V. Chen

*Attorney, Agent, or Firm*—Patterson & Keough

[57] ABSTRACT

A portable podium and performance platform system includes one or more platform sections that may be assembled together to provide one or more relatively small elevated surfaces having a horizontal orientation on which an individual or small group of individuals may stand or be seated so as to enhance communication and visibility. At least one of the platform sections includes an integral transport assembly for transporting the platform sections in a vertical orientation. The transport assembly comprises two or more wheels which are mounted on an axis of rotation that is transverse to the platform surface and positioned to allow at least an arcuate section of the wheels to extend beyond a peripheral edge of the platform surface. The podium and performance platform system may be transported to a desired location by tipping the platform sections into the vertical orientation and up onto the arcuate section of the wheels of the transport assembly, rolling the platform sections to the desired location, and then tipping the platform sections back down into the horizontal orientation.

17 Claims, 11 Drawing Sheets

PORTABLE PODIUM AND PERFORMANCE PLATFORM SYSTEM

RELATED APPLICATION

This application is a continuation-in-part application of a previously filed patent application entitled "PORTABLE HINGED RISER", Ser. No. 07/790,214, filed in the United State Patent and Trademark Office on Nov. 7, 1991, and assigned to the assignee of the present invention, a copy of which is attached to this application and the disclosure of which is hereby incorporated by reference in this application.

TECHNICAL FIELD

The present invention relates to podium and performance platform systems. In particular, it relates to a multi-level portable podium and performance platform system that can be easily assembled, disassembled and transported.

BACKGROUND OF INVENTION

Podium and performance platform systems provide a relatively small elevated surface on which an individual or small group may stand or be seated so as to enhance communication and visibility. Generally, the elevated surface of such a podium or performance platform system is no more than about one to two feet above ground level and has a surface area of less than about 20 sq. feet of surface area.

A podium system is typically used by a conductor in order to be more visible to an entire choral or orchestral group. A music stand may be positioned on or adjacent to the podium to hold sheet music or other materials. During rehearsal, the conductor may draw a chair up to the podium to be seated a portion of the time. A typical podium arrangement of this type is shown in U.S. Pat. No. 4,238,097, issued to Clausen et al, and assigned to the assignee of the present invention.

A performance platform system, on the other hand, is typically used by a small group or class to provided an elevated surface or a series of elevated risers in order to allow the group to be more visible to a teacher or audience. Most performance platform systems can be configured to provide a single elevated surface or multiple levels of elevated surfaces. A current example of such a performance platform system is marketed by the assignee of the present invention under the tradename flipFORMS TM and is shown and described in a previously identified parent application.

Other examples of fixed podium or performance platforms systems include U.S. Pat. No. 310,226, issued to Rice et al, U.S. Pat. No. 1,514,055, issued to Lawson, U.S. Pat. No. 2,841,831, issued to Mackintosh, U.S. Pat. No. 2,499,773, issued to Owens, U.S. Pat. No. 3,035,671, issued to Sicherman, and U.S. Pat. No. 4,580,776, issued to Burkinshaw.

Although such podium and performance platform systems are adequate for providing a relatively small elevated surface from which to enhance communication and visibility, these systems are sometimes difficult to transport and/or assemble. Consequently, it would be desirable to provide a portable podium and performance platform system capable of providing an elevated platform surface at one or more levels that can be easily assembled, disassembled and transported.

Several types of portable stages or platforms having multiple elevation levels are known in the art. Generally, these portable stages or platforms known in the art can be divided into one of three categories: foldable multi-level platforms, telescoping multi-level platforms or portable single-level platforms having an integral stairway.

Examples of foldable multi-level platforms include U.S. Pat. No. 3,747,706, issued to Paine et al., U.S. Pat. No. 3,747,708, issued to Wenger et al. U.S. Pat. No. Re.30,830, issued to Wenger et al., and U.S. Pat. No. 4,912,887, issued to Sullivan. Generally, these type of portable platforms have two or more platform surfaces that fold to a vertical orientation when transported. The platforms are supported by some type of carriage structure that usually includes two or more wheels attached to the bottom of the carriage structure to assist in transporting the folded platforms.

Examples of telescoping multi-level platforms include U.S. Pat. No. 3,400,502, issued to Scaggs et al. and U.S. Pat. No. 4,934,113 issued to Hall et al.. Generally, these type of portable platforms have two or more platform surfaces that telescope horizontally with the lowermost platform surface have two or more wheels attached to the underside of the platform to allow it to roll inward and outward on the ground or floor.

Examples of portable single level platforms with stairways include U.S. Pat. No. 2,362,170, issued to Swaisgood, U.S. Pat. No. 2,512,150, issued to Geren, U.S. Pat. No. 2,585,763, issued to Gasher et al., U.S. Pat. No. 2,798,652, issued to Easton, and U.S. Pat. No. 4,768,617, issued to Mason el al.. Generally, these types of portable platforms have a base with four or more wheels onto which a stairway is permanently attached leading to a single elevated platform.

In all of these systems, wheels are used to make the platform system easily portable. In each of these systems, however, the wheels are oriented such that the axis of rotation of the wheels is parallel to the plane of the platform surface. Although this makes the platform systems easier to transport, the addition of wheels to the platform systems generally require the use of a carriage or base on which to attach the wheels, thereby increasing the cost and weight of the platform system. In addition, the panels or platform sections of these platform systems generally are rigidly attached to adjacent panels or sections, not attached to each other at all, or are interconnected by slides, tracks, rails, cables, or the like. As a result, the panels or platform sections must be moved as a unit and cannot be handled separately. In addition, there is generally only one working arrangement for the components of these podium or performance platform systems.

While existing podium and platform systems of both the fixed and portable type are adequate for providing a relatively small elevated surface from which to enhance communication and visibility, it would be advantageous to provide an improved podium and performance platform system that is portable and can be assembled, disassembled and rearranged quickly and easily.

SUMMARY OF THE INVENTION

The present invention provides a portable podium and performance platform system. The podium and performance platform system includes one or more platform sections that may be assembled together. Each platform section includes two or more side-mounted wheels having an axis of rotation that is transverse to the platform surface and are mounted within one of the side walls of the platform section. When the podium or platform system is to be transported, each platform section is tipped up onto the side-mounted wheels, rolled to the desired location and then tipped back down into position.

The embodiment of a portable podium system in accordance with the present invention includes a base podium platform and secondary podium platform in a stacked or step-like configuration, wherein the podium platform sections can be used independently of one another to provide a single level podium system, or can be combined to provide a multi-level podium system. The portable podium system broadly includes two separate podiums or platform sections, a platform clamp mechanism, and a detachable railing assembly. Each platform has an integral transport assembly in the form of a pair of wheels mounted in one of the side walls. Although the base platform and secondary platform vary in size, each broadly induces a generally rectangular, relatively thin floor member, support leg members, the transport assembly and an enclosure assembly. The base platform and secondary platform may be detachably interconnected by a clamp mechanism.

The floor member presents a flat surface having a perimeter defined by a cladding frame for protecting the edge of the floor member and for securing carpeting, plastic matting, or the like, to the top surface of the floor member. The cladding frame comprises a resilient, generally C-shaped, cladding clamp having a lip on one end and a generally J-shaped cladding hook. The cladding clamp compresses the carpeting against the body member and is held in place against the carpeting and body member edge by the cladding hook which engages the lip of the cladding clamp.

The floor member is elevated vertically above the surface upon which the podium is resting by four or more leg members to present a generally horizontal load bearing surface. The floor member is fixedly attached to the support leg members, which are offset inwardly from the outside edge of the floor member. The leg members comprise relatively short, pillar-like uprights that have axes perpendicular to the plane of the floor member and are spaced at generally equidistant intervals from each other, thereby providing a supporting understructure for the floor member. The uprights may be interconnected by cross-supports for added stability.

The enclosure assembly broadly includes one or more side walls consisting of substantially rigid materials such as wood, metal or plastic. Alternately, flexible materials such as fabric, paperboard or rubber may be used for the side walls that do not have the transport assembly. The side walls are removably attached to the support legs around the perimeter of the floor member whereby the side walls substantially enclose the area below the floor member along all but one side of the platform section. In the preferred embodiment, the front one of the side walls contains an opening for allowing the legs of a music stand to be slid under the front portion of the platform section, thereby enabling the music stand to be drawn closer to the conductor, for example. Alternately, the rear one of the side walls may be removed to allow the legs of a chair or the like to be slid under the rear portion of the platform section.

In the preferred embodiment, the transport assembly is mounted within the front side wall and comprises two or more wheels or the like supported by brackets. The brackets are fixedly attached to the cross-supports whereby the axis of rotation of the wheels lies in a plane substantially transverse to the floor member. The wheels themselves are positioned in a plane that is substantially parallel to and just beneath the surface of the floor member. The wheels extend partially outward through complimentary open slots in the front side wall whereby a semicircular section of each wheel extends beyond the side wall and an arcuate section of the wheels extends beyond the cladded edge of the floor member.

The removable, articulated clamp mechanism comprises a base tab, an arm and a pivot joint joining the tab and arm. One end of the base tab is rigidly attached to a cross-support and the other end is pivotal connected to the arm at a pivot joint. The arm has clamp joint end and a free end. Adjacent the free end, the arm forms a generally U-shaped clasp having two substantially parallel flanges and a web extending substantially perpendicular between the flanges and thereby defining a floor member receiving space. The distance between the flanges of the clasp is slightly less than the width of the floor member adjacent its edge. The clamp has a storage position wherein the clamp arm is folded under and generally parallel to the underside of the floor member. When unfolded to hold the two platforms together, the clamp arm is generally perpendicular to the floor member.

An optional railing assembly comprises tubular rail supports connected to one or more of the platforms of the podium system and a U-shaped guard rail having two legs, each having a free end. The legs are joined by a substantially horizontal upright portion. Adjacent each free end, a tubular guard rail extension is attached to and extends generally perpendicularly away from the leg of the guard rail. The guard rail extensions are substantially parallel to each other and are received in the complementary rail supports. The extensions carry spring-driven locks and when the extensions have been sufficiently received within the rail supports of the platform, the locks automatically engage the apertures in the rail supports. The railing assembly may be used on any individual platform or podium of the podium system of the present invention, but typically would be used on the uppermost platform when a system is in a stacked arrangement.

In use, the podium system is moved or transported to the site where it will be used by tipping the entire podium system or each individual platform section of the system onto the edge with the transport assembly and rolling the platform sections on the wheels of the transport assembly. When two or more platforms are used to form the podium system, the base platform is positioned with the opening in the front side wall toward the orchestral or choral group and away from the audience. A secondary platform is then placed on the base platform whereby the legs of the secondary platform contact the floor of the base platform and the opening in the front side wall of the secondary platform also is away from the audience. The secondary platform's width may be less than that of the base platform, forming a stepped podium system. The secondary platform may also be positioned so that the step is on the right or the left, or so that a half step is on either side of the secondary platform.

The embodiment of a portable performance platform system in accordance with the present invention includes a hinged platform riser capable of being foldably configured into a single level arrangement, a bi-level platform and seat arrangement, or a multi-level riser arrangement. The portable performance platform system is a hinged riser unit that broadly includes a base, one or more generally rectangular step members, hinge mechanisms for pivotally, hingedly connecting the steps members to the base, and an integral transport assembly in the form of two pair of wheels mounted in the one of the side walls of the base and step members. By manipulating the hinged step members, the hinged riser unit may be re-shaped into a variety of configurations, including a storage and transport configuration. When the hinged riser unit is tipped into an upright position such that the two pair of wheels on the side wall are in contact with the floor or ground, the storage or transport configuration allows the portable performance platform system to be easily transported from one location to another.

The base of the hinged riser unit is a generally hollow single-piece body formed by a substantially continuous relatively thin wall or skin and in integral convoluted interior or internal support and baffle wall structure, which may be substantially filled with an appropriate low density, high volume material. Each step member may also be similarly constructed; however, the step members may or may not have an internal support wall. In the preferred embodiment, the hinged riser unit may be rotationally molded of a plastic material and includes integral hand grips to facilitate moving the individual step members or tipping the entire system onto the transport assembly. Two or more adjacent performance platform systems may be used together to form a riser assembly, for example, and the invention encompasses a connector key for connecting adjacent hinged riser units.

In the preferred embodiment, each step member is operably coupled to the base by a pair of twin axis hinges, including a hinge block received in a pair of complementary hinge wells located along each of the adjacent corner edges of the base and step members. The hinges are self-leveling to present a substantially smooth, level platform support surface in every possible configuration. By locating the hinges at the corner edges, the hinges do not interfere with the use of the entire platform support surface.

In the preferred embodiment, the transport assembly includes a first pair of wheels mounted in the rear side wall of the base and a second pair of wheels mounted in a rear side wall of one of the topmost one of the step members. Each of the wheels is mounted in a recessed fashion such that only an arcuate portion of the wheel extends beyond the surface of the rear side wall. In addition, a corresponding wheel cavity is positioned adjacent each wheel on both the base and the topmost step member such that when the base and topmost step member are unfolded in a single level platform position, the pair of wheels in the base member extend into the pair of wheel cavities on the topmost step member, and the pair of wheels in the topmost step member extend into the pair of wheel cavities on the base member, thereby allowing the base member and the topmost step member to be unfolded such that the rear wall of each member is in an adjacent planar orientation with each other.

It is a primary objective of the present invention to provide an improved podium and performance platform system that is portable and can be assembled, disassembled and rearranged quickly and easily.

Another primary objective of the present invention is to provide a podium and performance platform system that includes a transport assembly integrally carried by the platforms for moving the platforms individually or as a system which does not require adjustment, positioning, or other manipulation prior to use.

It is a further objective of the present invention to provide a flexible and versatile portable podium system consisting of multiple platforms, panels or stages used individually or in combination.

It is a still further objective of the present invention to provide a flexible and versatile portable performance platform system consisting of a hinged riser capable of being foldably configured into multiple configurations.

When more than one platform is used for the podium system, a related objective of the present invention is to provide a podium system in a stacked configuration that can be realigned quickly and easily to alternative configurations using a mechanism for quickly and easily attaching and detaching the platforms to each other without the use of tools.

It is another objective of the present invention to provide a podium system that includes a detachable guard rail that can be secured without the use of tools and that has an opening in one of the side panels to enable the user to slid the legs of a music stand or the like under the platform surface.

Other objects and advantages of the podium system of the present invention will be understood with reference to the following specification and appended drawings and claims.

BRIEF DESCRIPTION OF THE DRAWINGS

FIG. 15*a* is an elevational view of the inward facing side of the clamp depicted in FIG. 15;

DETAILED DESCRIPTION OF THE PREFERRED EMBODIMENT

The portable podium and performance platform system that is the subject of the present invention is designed to provide a relatively small elevated surface on which an individual or small group may stand or be seated so as to enhance communication and visibility. Generally, the elevated surface of such a podium or performance platform system is no more than about one to two feet above ground level and has a surface area of less than about 20 sq. feet of surface area. The load bearing capacity of such podium and performance platforms systems is typically less than about 125 lbs./sq.ft. The overall construction of a portable podium and performance platform system in accordance with the present invention must be such that each unit weighs less than approximately 100 lbs. and can be easily manipulated by a single individual without requiring mechanical assistance.

The detailed description of the present invention will set forth two alternate embodiments, the portable podium system and the portable performance platform system. It will be understood that these two systems are unique, but related, in that each system is designed to enhance communication and visibility between an individual and a group. The difference between the podium system and the performance platform system lies in whether it will be the group or the individual that will be using the elevated surface.

Podium System Embodiment

Figure 1:
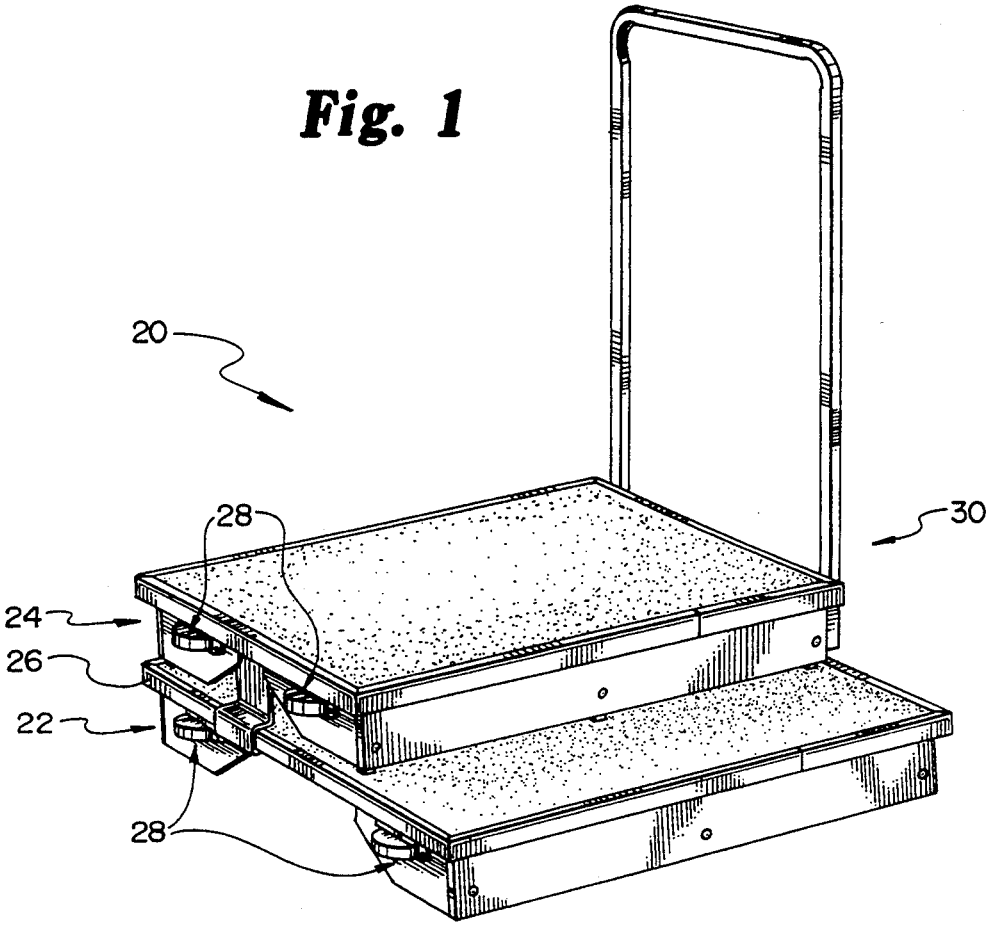
FIG. 1 is a perspective view of the portable podium system of the present invention.

Referring now to FIG. 1, the podium system 20 of the present invention includes a base platform 22, a secondary platform 24, a platform clamp assembly 26, transport assembly 28 and guard rail assembly 30. It should be understood that the podium system 20 of the present invention also may broadly include additional platforms substantially similar to the secondary platform 24. In the preferred embodiment, each of the base platform 22 and the secondary platform 24 are approximately 6" high. The dimensions of the base platform 22 are approximately 38"×43", and the dimensions of the secondary platform 24 are approximately 32"×38". As previously indicated, these dimensions are such that a relatively small elevated platform can be provided on which an individual or group may stand or be seated.

Figure 2:
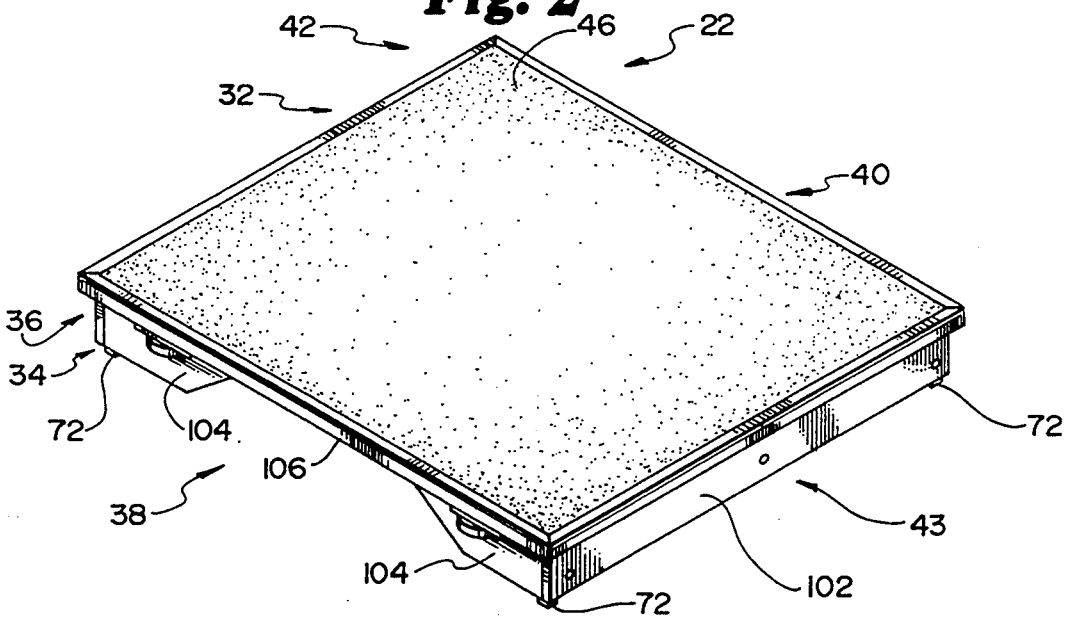
FIG. 2 is a perspective view depicting the base platform or podium.
Figure 4:
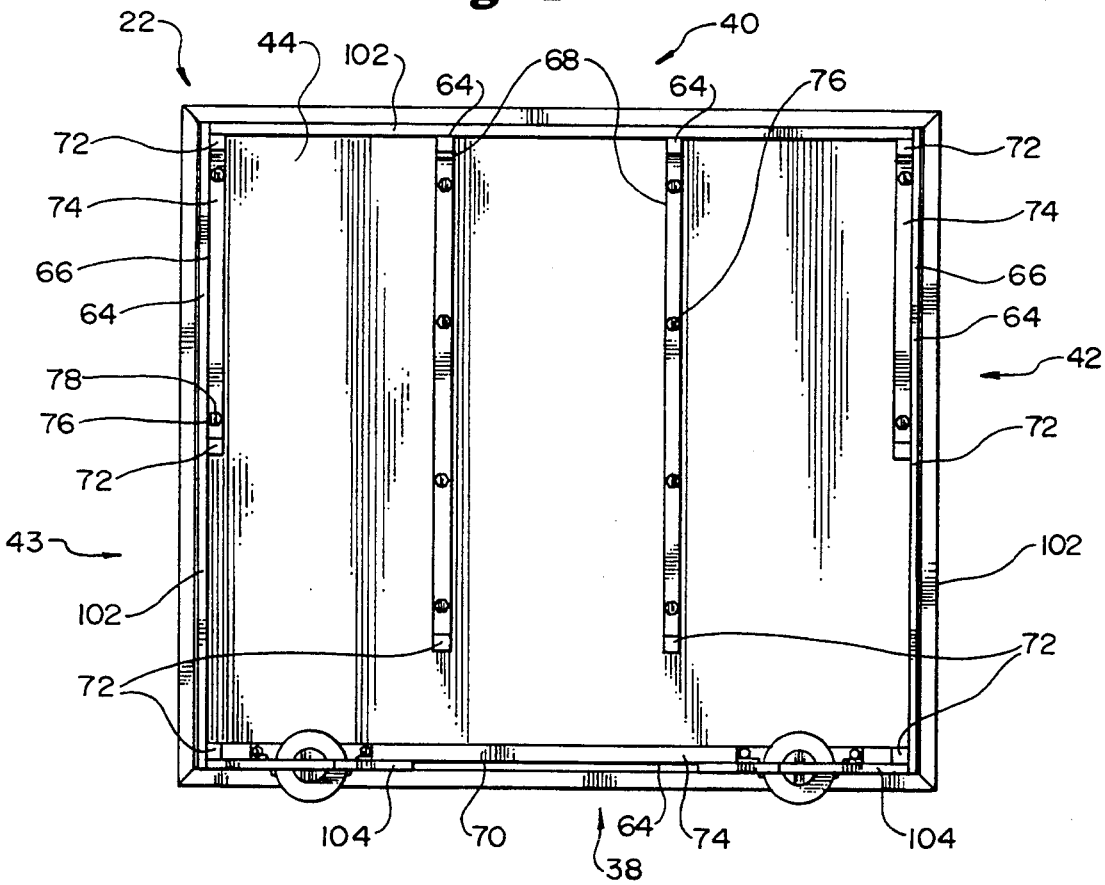
FIG. 4 is a bottom plan view of the base platform.
Figure 4A:
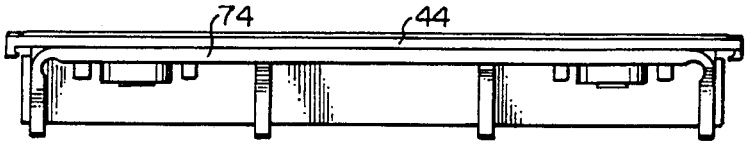
FIG. 4*a* is an elevation view of the base platform of the present invention.

Referring to FIGS. 2 and 4, the base platform 22 broadly comprises a body member 32, support frames 34, and enclosure assembly 36, and is a generally rectangular, rigid component having front 38, back 40, and lateral 42, 43, sides substantially enclosing a generally empty interior. The designation of front 38, back 40 and lateral 42, 43, reflect the position of the base platform's 22 sides relative to the location of the transport assembly 28.

Figure 16:
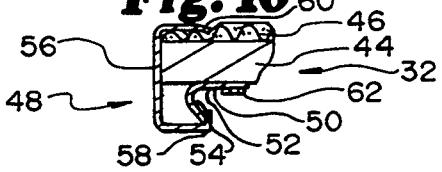
FIG. 16 is a fragmentary detail view of circled area 16 of FIG. 14.

Referring to FIG. 16, the body member 32 includes a floor 44, a floor covering 46 and cladding frame 48. The cladding frame 48 includes a generally J-shaped cladding hook 50 having a straight base 52 and a curved ridge 54 and a relatively resilient, generally C-shaped cladding clamp 56 having an arcuate lip 58 on one end and a retaining tab 60 at the other end. The retaining tab 60 angles slightly towards the lip 58 of the cladding clamp 56. The periphery of the body member 32 is defined by four cladding hooks 50 and four cladding clamps 56, each cladding hook 50 and cladding clamp 56 corresponding to and being substantially the same length as one edge of the floor 44.

Each cladding hook 50 base 52 is rigidly attached to the underside of the floor 44 by screws, 62 rivets or the like, so that the ridge 54 of the cladding hook 50 depends downwardly from generally adjacent the outside, lower edge of the floor 44. The floor covering 46 is secured against the floor 44 by the retaining tab 60. The ridge 54 of the cladding hook 50 engages the cladding clamp 56 lip 58 to hold the cladding clamp 56 in place.

Referring again to FIGS. 2 and 4, the floor 44 is fixedly attached to and elevated vertically above the surface upon which the base platform 22 is resting by five support frames 64 whereby the floor 44 presents a generally horizontal surface. The support frames 64 consist of two outer support frames 66, two center support frames 68, and one front support frame 70. Each support frame 64 is a continuous, rigid, generally C-shaped element that includes two relatively compact legs 72 and a relatively long bridge member 74. The bridge member 74 of each support frame 64 is fixedly attached to the underside of the floor 44 with screws 76 that are driven into the floor 44 through holes 78 in the bridge members 74 of the support frames 64. Other typical fastening methods such as rivets, nails or bolts may also be used.

The bridge member 74 of the front support frame 70 is attached to the underside of the floor 44 adjacent to and substantially coplanar to the front side 38 of the body member 32, whereby the legs 72 of the front support frame 70 are substantially adjacent to the corners created by the front side 38 abutting the lateral sides 42, 43, respectively, of the body member 32.

The outer support frames 66 are attached to the underside of the floor 44, whereby the bridge member 74 of each outer support frame 66 is adjacent to and substantially coplanar with one of the lateral sides 42, 43, respectively, of the body member 32. The length of the bridge member 74 of each outer support frame 66 is generally one-half the length of its corresponding lateral side 42, 43, respectively. The outer support frames 66 are positioned on the underside of the floor 44 whereby one leg 72 of each outer support frame 66 is substantially adjacent one of the corners formed by the rear side 40 of the body member 32 abutting the lateral sides 42, 43, respectively, of the body member 32 and the second leg 72 of each respective outer support frame 66 is generally midway between the back side 40 and the front side 38 of the body member 32.

The bridge members 74 of the center support frames 68 are longer than the bridge members 74 of the outer support frames 66, are parallel and adjacent to each other, and are positioned between and parallel to the outer support frames 66 along the underside of the floor 44. The bridge members 74 of the center support frames 68 are attached to the underside of the floor 44, whereby the distance between the two center support frames 68 and the distance between the either center support frame 68 and its nearest outer support frame 66, are generally equal. The center support frames 68 are positioned on the underside of the floor 44 whereby one leg 72 of each center support frame 68 is substantially adjacent the rear edge 40 of the body member 32 and the second leg 72 of each respective center support frame 68 is generally adjacent the front side 38 of the body member 32.

Figure 5:
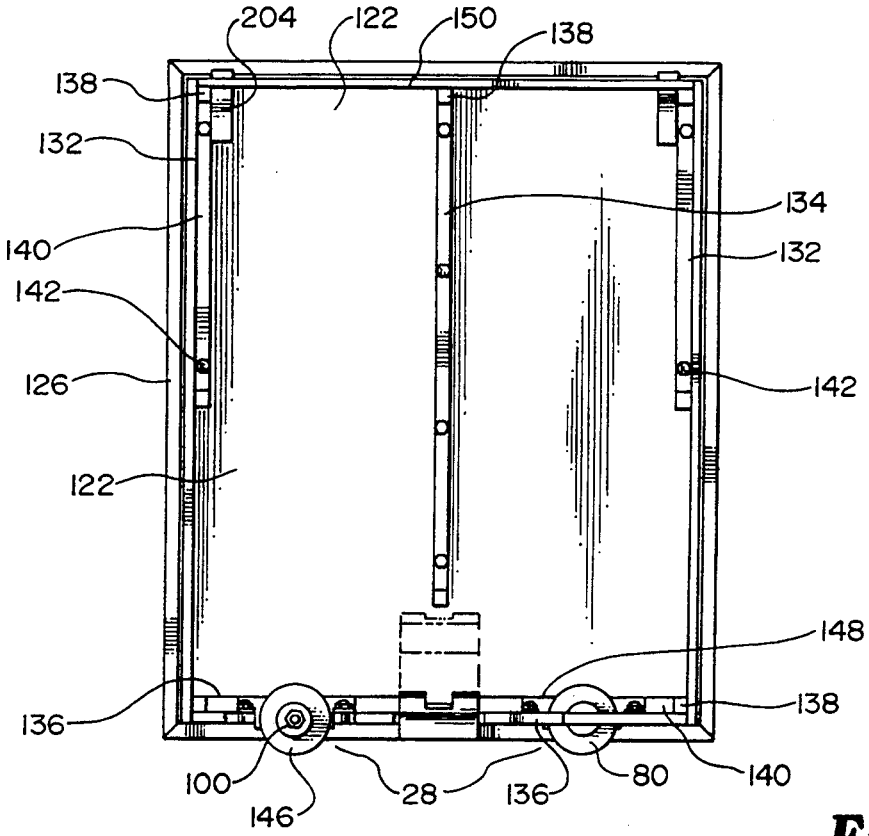
FIG. 5 is a bottom plan view of the upper or secondary platform, with parts cut away to depict wheels of the transport assembly.
Figure 5A:
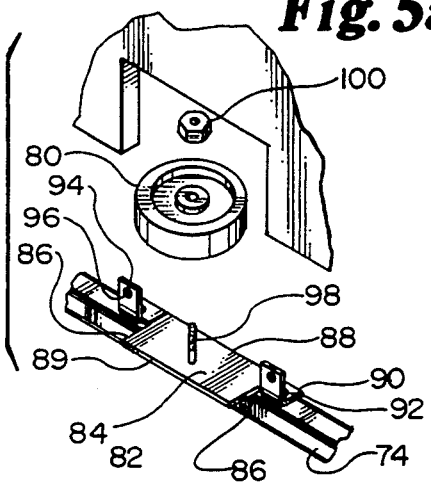
FIG. 5*a* is an exploded perspective view depicting the wheel mounting.

Referring to FIGS. 4 and 5*a*, the transport assembly 28 includes a pair of wheels 80 each supported by a bracket assembly 82. Each bracket assembly 82 includes a generally rectangular bracket plate 84 having two relatively short sides 86 and two relatively long sides 88, 89, a pair of mounting flanges 90 each having a centrally located mounting flange aperture 92, a pair of ears 94 each having a centrally located ear aperture 96 and a threaded, cylindrical rod or wheel axle 98 rigidly attached to and generally positioned in the center of the bracket plate 84.

The mounting flanges 90 extend out from the short sides 86, of the bracket plate 84 and are generally rectangular, continuous extensions of a portion of the bracket plate 84 whereby only one long side 88 of the bracket plate 84 is continuous with one side of each mounting flange 90. Each ear 94 is a continuous extension of a mounting flange 90, both ears are perpendicular to the mounting flanges 90 and the bracket plate 84, and the ears 94 lie in the same plane.

Each wheel bracket plate 84 is rigidly attached to the underside of the bridge member 74 of the front support frame 70 at a point generally adjacent to the front support frame 70 legs 72, by driving metal screws 99 through the mounting flange apertures 92 and bridge member 74 holes 78, and into the floor 44. Other typical fastening methods such as rivets, bolts, or the like, may be used. When attached to the front support frame 70, the continuous edge formed by the sides of the mounting flanges 90 and the bracket plate 84 of each bracket assembly 82 faces the interior of the base platform 22 and the wheel axles 98 extend away from the underside of the floor 44 and bridge member 74, whereby the axis A of wheel rotation is perpendicular the plane of the floor 44 as seen in FIG. 4. The wheels 80 are rotatable connected to wheel axles 98 by retaining nuts 100.

Figure 12:
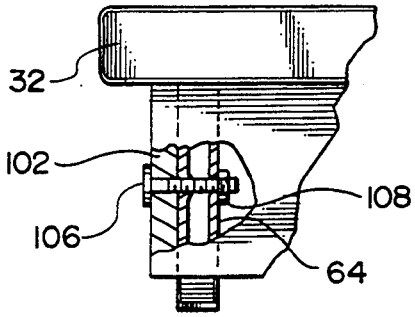
FIG. 12 is a fragmentary side elevation detail with parts cut away, depicting the side panels of the present invention.

Referring again to FIGS. 2 and 4, the enclosure assembly 36 of the base platform 22 includes three generally rectangular, rigid side walls 102 and two generally trapezoidal, rigid front wall portions 104. The rectangular side walls 102 are removably attached to the legs 72 of the support frames 64 by bolts 107 secured by nuts 108 as seen in FIG. 12. The rectangular side walls 102 substantially enclose the lateral sides 42, 43 and the back side 40 of the base platform 22. Two rectangular side walls 102 are attached along the lateral sides 42, 43 of the base platform 22 by bolting each rectangular side skirt 102 to the legs 72 of the corresponding outer support frame 66 and one leg 72 of the front support frame 70. The third rectangular side skirt 102 is attached along the back side 40 of the base platform 22 by bolting the rectangular side wall 102 to one leg 72 of each outer support frame 66 and one leg 72 of the two center support frames 68.

The trapezoidal front wall portions 104 partially enclose the front side 38 of the base platform 22, whereby a substantial opening or void 106 remains at an area centrally located along the front side 38, as seen in FIG. 2. Referring to FIGS. 4 and 5*a*, the two trapezoidal side walls 104 are attached along the front side 38 of the base platform 22 by bolting each trapezoidal side wall 104 to the bracket assembly 82 ears, The wheels 80 extend through complimentary open slots 108 in the trapezoidal walls 104 whereby a semicircular section of each wheel 80 extends beyond the side wall 104 and an erect section extends beyond the clouded periphery of the body member 32.

Referring to FIG. 1, the secondary platform 24 and the base platform 22 are substantially similar, but the secondary platform 24 carries a platform clamp mechanism 26, supports a guard assembly rail 30, and the width of the secondary platform 24 is substantially less than that of the base platform 22. Additional differences between the secondary platform 24 and the base platform 22 can be observed by comparing FIGS. 4 and 5.

Figure 3:
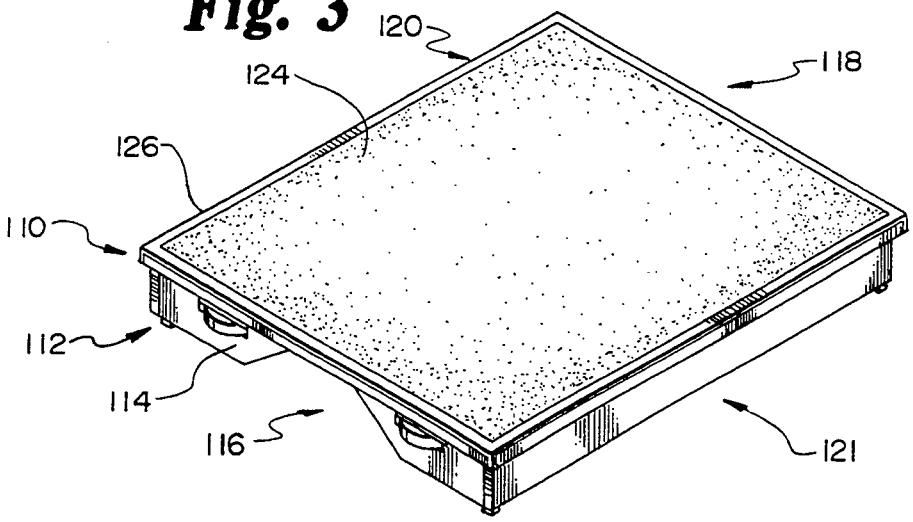
FIG. 3 is a perspective view depicting the upper or secondary podium or platform.

Referring to FIGS. 3 and 5, the secondary platform 24 broadly comprises a body member 110, support frames 112, and enclosure assembly 114, and is a generally rectangular, rigid component having front 116, back 118, and lateral 120, 121, sides substantially enclosing a generally empty interior. The designation of front 116, back 118, and lateral 120, 121, also reflect the position of the secondary platform's 24 sides relative to the location of the transport assembly 28. As with the base platform 22, the body member 110 of the secondary platform includes a relatively thin, rigid floor 122, a pliable, slip resistant floor covering 124 and cladding frame 126 defining the outside edge or periphery of the body member 110.

Figure 6:
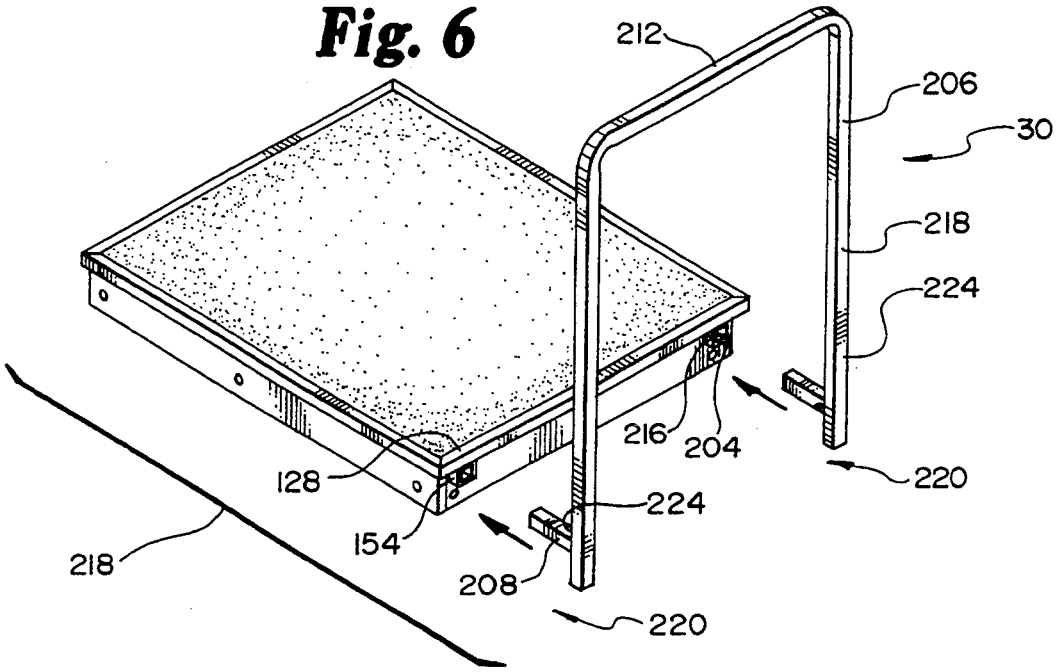
FIG. 6 is an exploded perspective view depicting the guard rail assembly.

Referring to FIG. 16, the cladding frame 126 of the secondary platform 24 is substantially the same as the cladding frame 48 of the base platform 22 previously described herein. Unlike the base platform 22, the uppermost surface of the cladding clamp 126 defining the outside edge of the back 118 side of the body member 110 of the secondary platform 24 carries two substantially square-shaped platform Velcro® pads 128 as depicted in FIG. 6.

Referring again to FIGS. 3 and 5, the floor 122 of the secondary platform 24 is fixedly attached to and elevated vertically above the surface upon which the secondary platform 24 is resting by four support frames 130 whereby the floor 122 presents a generally horizontal surface. The support frames 130 consist of two outer support frames 132, one center support frame 134 and one front support frame 136. Each support frame 130 is a continuous, rigid, generally C-shaped element that includes two relatively compact legs 138 and a relatively long bridge member 140. The bridge member 140 of each support frame 130 is fixedly attached to the underside of the floor 122 with screws 142 that are driven into the floor 122 through holes 144 in the bridge members 140 of the support frames 130. Other typical fastening methods such as rivets, rails or bolts may be used.

The bridge member 140 of the front support frame 136 is attached to the underside of the floor 122 adjacent to and substantially coplanar with the front side 116 of the body member 110, whereby the legs 138 of the front support frame 136 are substantially adjacent to the corners created by the front side 116 of the body member 110 abutting and the lateral sides 120, 121 of the body member 110. The outer support frames 132 are attached to the underside of the floor 122, whereby the bridge member 140 of each outer support frame 132 is adjacent to and substantially coplanar with one of the lateral sides 120, 121, respectively, of the body member 110. The length of the bridge member 140 of each outer support frame 132 is generally one-half the length of its corresponding lateral side 120, 121, respectively. The outer support frames 132 are positioned on the underside of the floor 122 whereby one leg 138 of each outer support frame 132 is substantially adjacent one of the corners formed by the rear side 118 abutting the lateral sides 120, 121 of the body member 110 and the second leg 138 of each respective outer support frame 132 is generally midway between the back side 118 and the front side 116 of the body member 110.

The bridge member 140 of the center support frame 134 is longer than the bridge members 140 of the outer support frames 132, and is positioned equidistant between and parallel to the outer support frames 132 along the underside of the floor 122. The bridge member 140 of the center support frame 134 is positioned on the underside of the floor 122 whereby one leg 138 of the center support frame 134 is substantially adjacent the rear edge 118 of the body member 122 and the second leg 138 of the center support frame 134 is generally adjacent the front side 116 of the body member 110.

Referring to FIG. 5, the transportation assembly 28 of the secondary platform 24 induces a pair of wheels 146 each supported by a bracket assembly 148. Referring to FIG. 5*a*, the bracket assembly 148 of the secondary platform 24 is substantially the same as the bracket assembly 82 of the base platform 22 as previously described herein.

Referring to FIGS. 3 and 5, the enclosure assembly 114 of the secondary platform 24 includes three generally rectangular, rigid side walls 150 and two generally trapezoidal, rigid front wall portions 152. Referring to FIGS. 2 and 4, the enclosure assembly 114 of the secondary platform 24 is substantially the same as the enclosure assembly 36 of the base platform 22 as previously described herein. Referring to FIGS. 5 and 6, unlike the third rectangular side wall 102 of the base platform 22, the third rectangular side wall 150 of the secondary platform 24 is attached along the back side 118 of the secondary platform 24 by bolting the rectangular side wall 150 to one leg 138 of each outer support frame 132 and one leg 138 of the center support frame 134. The third rectangular side wall 150 has two generally U-shaped rail support voids 154. Each support void 154 is offset slightly inwardly from one of the legs 138 of the outer support frames 132 and is substantially adjacent the underside of the floor 122.

Figure 13:
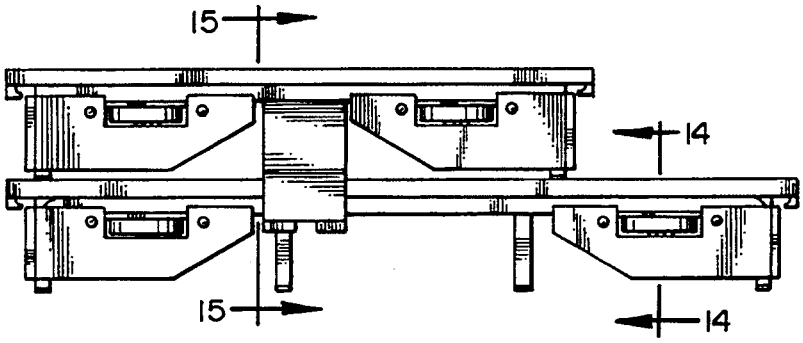
FIG. 13 is an elevational view thereof, depicting the wheels of the transport assembly of the present invention.
Figure 13A:
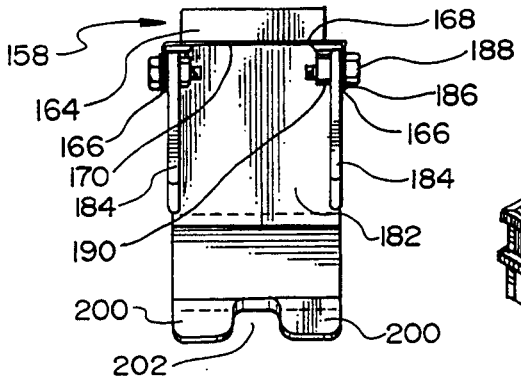
Figure 15:
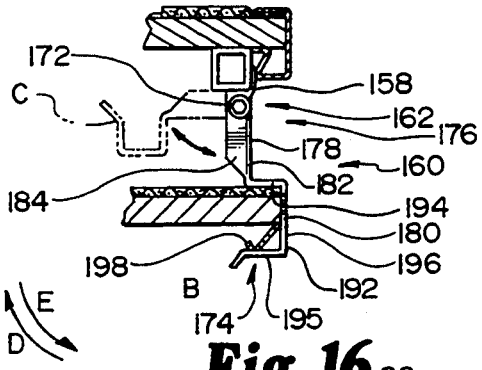
FIG. 15 is a sectional view taken along line 15—15 of FIG. 13.

Referring to FIG. 15 and FIG. 13*a*, the platform clamp assembly 26 has a clamp position B and a storage position C (shown in phantom) and includes a base tab 158, a clamp 160 and a clamp joint 162, joining the base tab 158 and clamp 160. The base tab 158 is an irregular unitary member inducing a tab lip 164, two wings 166, and a rectangular clamp plate 168 having a central aperture 170. The relatively flat clamp plate 168 is fixedly attached to the underside of the front support frame's 136 bridge member 140 at a point substantially midway between the two legs 138 of the front support frame 136, as depicted in FIG. 13. The tab lip 164 is a rectangular unitary member extending upwardly and perpendicularly away from the clamp plate 168. The tab lip 164 is slightly smaller than the clamp plate 168 and is substantially coplanar with the outward-facing side of the bridge member 140 of the front support frame 136. The wings 166 are relatively short extensions of opposite ends of the clamp plate 168 each forming a base tab aperture 172 and extending downwardly.

The clamp 160 is a unitary member having a free end 174 and a clamp joint end 176. The clamp 160 includes an arm member 178 and a dag 180. The generally U-shaped arm member 178 has a spine 182 and a pair of generally rectangular shoulders 184 wherein each shoulder 184 has a shoulder aperture 186 substantially adjacent the clamp joint end 176. The clamp joint 162 is formed by a two relatively short bolts 188 each which are received in a shoulder aperture 186 and base tab aperture 172 and secured by a nut 190. The base tab 158 and clamp 160 are joined whereby the spine 182 of the arm member 178 of the clamp 160 and the clamp plate 168 are generally coplanar when the clamp 160 is in the storage position C and occupy substantially perpendicular planes when the clamp 160 is in the clamp position B.

The clasp 192 is a generally U-shaped member having two substantially parallel flanges 194, 195, a web 196 extending substantially perpendicular between flanges 194, 195, and thereby defining a body member receiving space 198 and two spurs 200 extending from the distal-most flange 195 adjacent the free end 174 of the clamp 160. The proximate flange 194 is a continuous extension of the spine 182 of the arm member 178. The shoulders 184 of the arm member 178 angle toward and terminate at a substantially 90° degree bend that marks the transition from the arm member 178 portion of the clamp 160 to the clasp 192 portion of the clamp 160.

The spurs 200 are continuous extensions of a portion of the distal-most flange 195 adjacent the free end 174 of the clamp 160 and are separated by a slot 202 generally equal in size to the width of a support frame 130 leg 138. The spurs 200 are coplanar and angle away from the body member receiving space 198.

Figure 8:
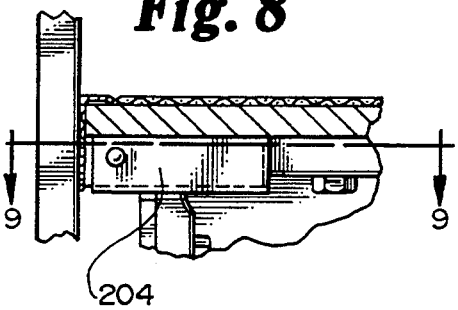
FIG. 8 is a fragmentary sectional view taken along line 8—8 of FIG. 7.
Figure 7:
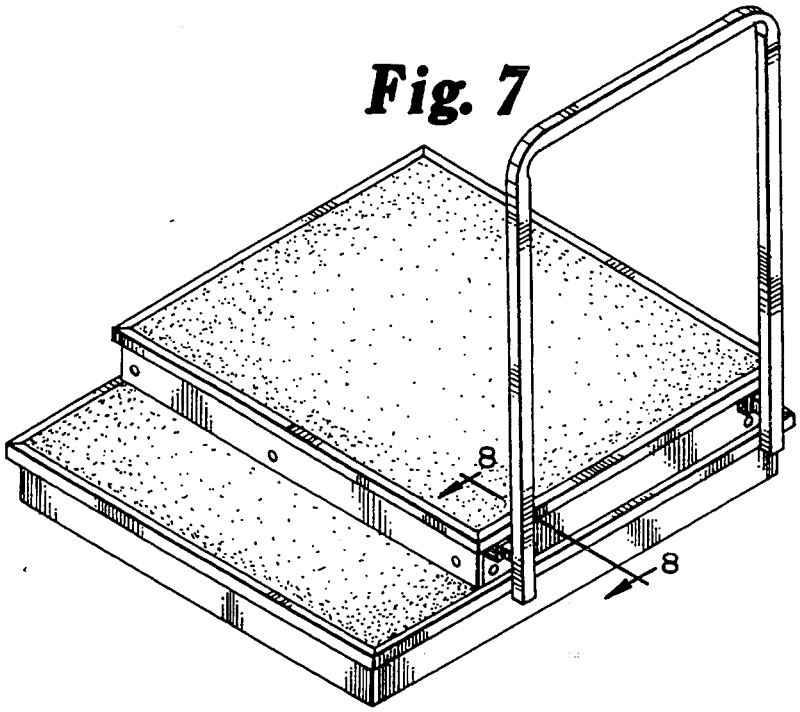
FIG. 7 is a perspective view depicting guard rail assembly in place on the podium system of the present invention.
Figure 9:
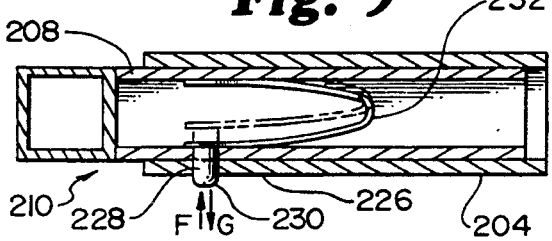
FIG. 9 is a sectional view taken along line 9—9 of FIG. 8.

Referring to FIGS. 6, 7, and 9, the guard rail assembly 30 includes two rail supports 204, a generally U-shaped guard rail 206, two guard rail extensions 208 and two releasable lock mechanisms 210. As best seen in FIG. 5, each guard rail support 204 is rigidly attached to the inside edge of one of the outer support frames 132, and extends outwardly beyond the outer support frames 132 passing through the rail support holes 212 of the third rectangular or back side wall 150. As seen in FIGS. 6 and 8, each rail support 204 has a latch pin hole 216, whereby the latch pin holes 216 face each other. The rail supports 204 extend beyond the back side wall 150 to sufficiently expose the latch pin holes 216 beyond the back side wall 150.

The guard rail 206 includes two uprights 218 having a free ends 220 and being joined by a substantially straight upright section 222. Adjacent the free ends 220 a guard rail extension 208 is rigidly attached to and extends perpendicularly away from each upright 218, whereby the guard rail extensions 208 are substantially parallel to each other. Attached to each guard rail upright 218, immediately above and on the side where the guard rail extensions 208 and uprights 218 are joined, is a guard rail Velcro ® pad 224. As best seen in FIG. 9, each guard rail extension 208 has a latch pin aperture 226, whereby the latch pin apertures 226 face each other. The outside dimensions of a guard rail extension 208 is slightly smaller than the inside dimensions of a rail support 204. FIG. 9 also depicts the lock mechanism 210 carried within the interior of both guard rail extensions 208. The lock mechanism 210 includes a latch pin 228 having a substantially rounded head 230 carried by a leaf spring 232.

In use, the podium system 20 is delivered to the site where it will be assembled by employing the transport assembly 28. The podium system 20 is designed so that the individual platform sections can be moved separately on wheels 80 that are carried by each platform or together as an entire unit. The user lifts up anywhere along the back side 40 of the base platform 22 until the back side 40 is at its uppermost position, whereby the plane of the body member 32 is substantially vertical. When the body member 32 is substantially vertical the wheels 80 support the base platform 22 above the stage or floor enabling the base platform 22 to be rolled on the wheels 80. When the user arrives at the assembly site the user simply lowers the base platform 22 until it is horizontal.

The secondary platform 24 is delivered to the assembly site in the same manner as the base platform 22, but with the following additional considerations. The platform clamp mechanism 26 carried by the secondary platform 24 should have been returned to its storage position C, adjacent to and generally coplanar with the underside of the floor 122, when it was last separated from the base platform 22. If not in its storage position C, the clamp 160 is pushed towards the underside of the floor 122 in the direction of arrow D as depicted in FIG. 15.

Figure 17:
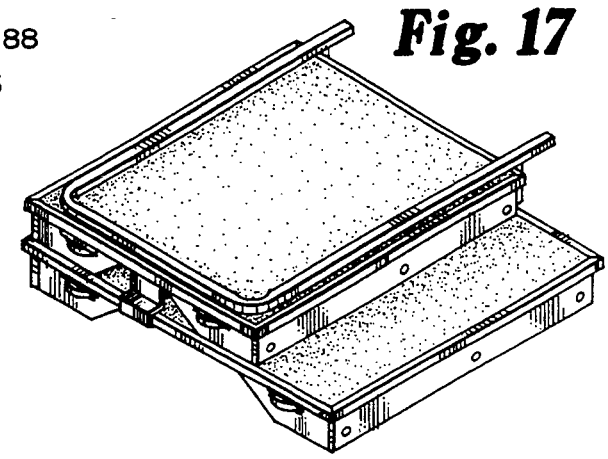
FIG. 17 is a perspective view depicting the podium system of the present invention ready for transport.
Figure 14:
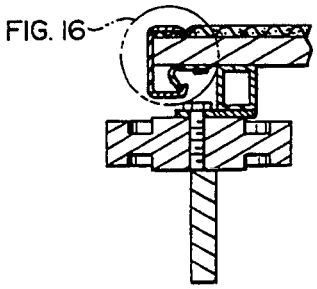
FIG. 14 is a sectional view taken along line 14—14 of FIG. 13.
Figure 18:
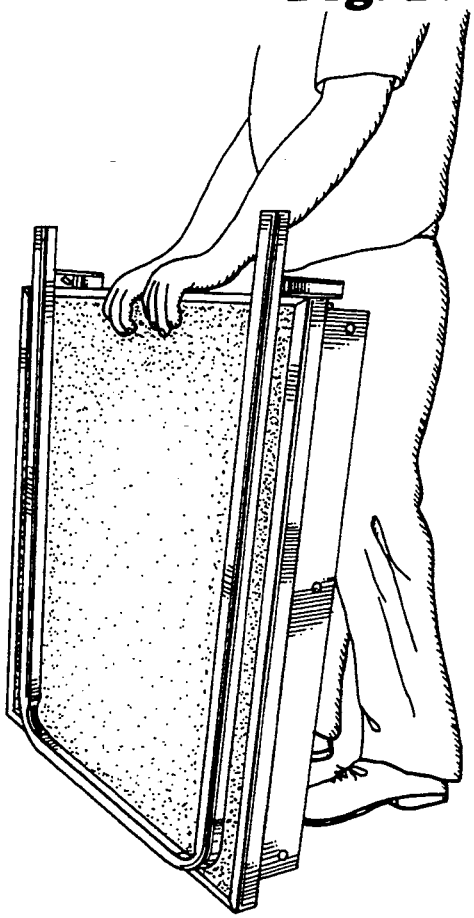
FIG. 18 is a perspective view thereof, depicting one of the podium platforms being rolled.

Referring to FIG. 17, before the secondary platform 24 is repositioned to take advantage of its transport assembly 28, the guard rail 206 is placed on the body member 110 whereby the upright portion 212 is substantially adjacent and parallel to the front 116 side of the secondary platform 24 and the uprights 218 are generally adjacent and parallel to the lateral sides 120,121 of the secondary platform 24. The guard rail 206 can then be adjusted on the secondary platform 24 so that the two guard rail Velcro ® pads 224 engage the two platform Velcro ® pads 128. Referring to FIG. 18, the secondary platform 24 can now be lifted so that it is in transportation position as depicted in FIG. 18 and rolled to the assembly site. The secondary platform 24 is then returned to its original position whereby the body member 110 is supported vertically by the legs 138 of the support frames 130.

Figure 10:
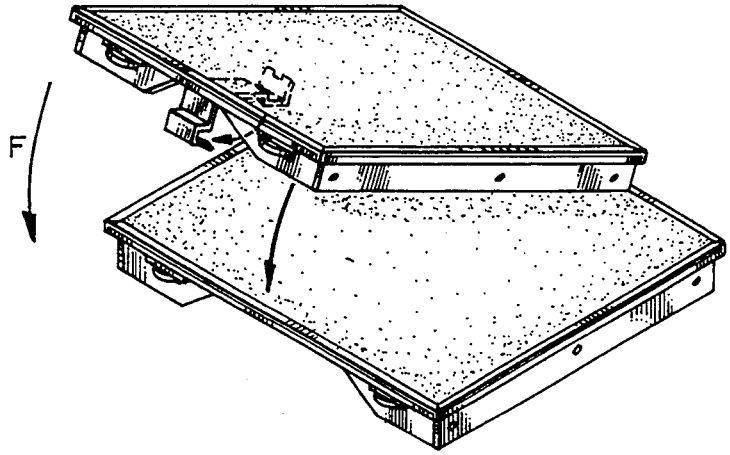
FIG. 10 is a perspective view depicting an initial step in forming a stacked podium system.
Figure 11:
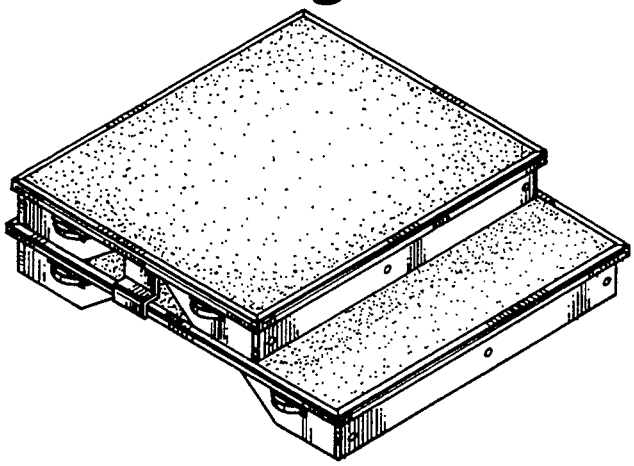
FIG. 11 is a perspective view depicting two platforms connected by the podium clamp of the present invention.

Referring to FIG. 1, wherein a stacked podium system 20 is depicted, the base podium 22 is positioned first, whereby the front side 38 of the base podium 22 faces the audience as seen in FIG. 2. Referring to FIG. 10, the secondary platform 24 is then partially placed upon the base platform 22 so that the legs 138 adjacent the back side 118 of the secondary platform 24 contact the floor covering 46 adjacent the rear side 40 of the base platform 22. While holding the front side 116 of the secondary platform 24 elevated above the base platform 22 as depicted in FIG. 10, the clamp 160 is pivoted from its storage position C as depicted in FIG. 15 by pulling the clamp 160 in the direction of arrow E slightly past or beyond its clamp position B. When the clamp 160 is positioned beyond its clamp position B, the secondary platform 24 is lowered onto the base platform 22. (in the direction of arrow F in FIG. 10) In the preferred embodiment as depicted in FIG. 11, the secondary platform 24 has been aligned on the base platform 22 so the right lateral side 120 of the secondary platform 24 is coplanar with the right lateral side 42 of the base platform 22.

When the platforms are aligned, the clamp 160 is pivoted back towards the clouded front side 38 of the base platform's 22 body member 32 (in the direction of arrow D in FIG. 15). As the clasp 192 of the clamp 160 nears the body member 32, the spurs 200 of the clasp 192 initiate the coupling action between the dag 192 and the clouded body member 32. The user continues to push the clamp 160 in the direction of arrow D in FIG. 15 until the clouded body member 32 fully occupies the body member receiving space 198 .

Referring to FIG. 6, the user then positions the guard rail 206 adjacent the rail supports 204 whereby the axes of the guard rail extensions 208 and the rail supports 204 are coaxial. The guard rail extensions 208 are inserted into the rail supports 204 and the user pushes the guard rail 206 toward the secondary platform 22 until the releasable lock mechanisms 210 carried by the guard rail extensions 208 engage the rail supports 204 thereby securing the guard rail 206 to the secondary platform 24 as depicted in FIGS. 7 and 8. As the guard rail extension 208 slides into the rail support 204 the rounded head 230 of the latch pin 228 contacts the rail support 204 which drives the latch pin 228 into the interior of the guard rail extension 208 (in the direction of arrow F in FIG. 9). When the latch pin 228 reaches the latch pin hole 216 of the rail support 204 the leaf spring 232 drives the latch pin 228 into the latch pin hole 216 (in the direction of arrow G in FIG. 9), thereby locking the guard rail extension 208 to the rail support 204.

To disassemble the podium system 20, the foregoing steps are reversed. However, to release the guard rail 206 from the rail supports 204 the preferred method is for the user to face the back side 118 of the secondary platform 24 between the guard rail uprights 218. The user then grasps the uprights 218 daisy wheel adjacent and slightly above the guard rail extensions 208 whereby the user can slightly rotate the user's hands and thereby position each thumb over a corresponding latch pin 228. While depressing the latch pin 228 towards the interior of the guard rail extension 208 (in the direction of arrow F in FIG. 9), the user simultaneously pulls away from the secondary platform 24, thereby sliding the guard rail extensions 208 out of the rail supports 204.

Referring to FIG. 16, the floor covering 46 of the base platform 22 can be replaced by removing the cladding clamps 56. A prying-type tool is used to engage the lip 58 of a cladding clamp 56. By prying the lip away from a cladding hook 50 the cladding clamp 56 is removed from the body member 32 of the base platform 22. When all four cladding clamps 56 have been removed the floor covering 46 can be removed. The replacement floor covering 46 should be substantially the same dimensions as the floor 44 or slightly smaller. When the new floor covering 46 has been properly positioned, the cladding clamps 56 are replaced by first pushing the inside edge of the cladding clamp 56 against the outside edge of the floor 44 whereby the lip 58 is substantially adjacent the underside of the floor 44 and a gap exists between the retaining tab 60 and the floor covering 46. The cladding clamp 56 is then pushed down so that the retaining tab 60 compresses the floor covering 46 and the lip 58 is pressed against the outside edge of the cladding hook 56. To secure the cladding clamp 56 the bottom outside edge is pressed inwardly thereby driving the lip 58 over the ridge 54 of the cladding hook 50. The floor covering 124 of the secondary platform 24 is removed in substantially the same manner as the floor covering 46 of the base platform 22 as described above.

In the preferred embodiment, the components of the podium system of the present invention, including the platform clamp assembly 26, guard rail assembly 30, bracket assemblies 82, 148, support frames 64, 130, and cladding frames 48, 126 may be formed from suitable gauge steel and may be vinyl or plastic coated. The floors 44, 122 and enclosure assemblies 36, 114 may be formed from wood, synthetics or a combination thereof. The wheels 80 may be made of plastic or rubber. Other appropriate materials, such as aluminum or plastic, may be used for any of the components.

Performance Platform Embodiment

Figure 19:
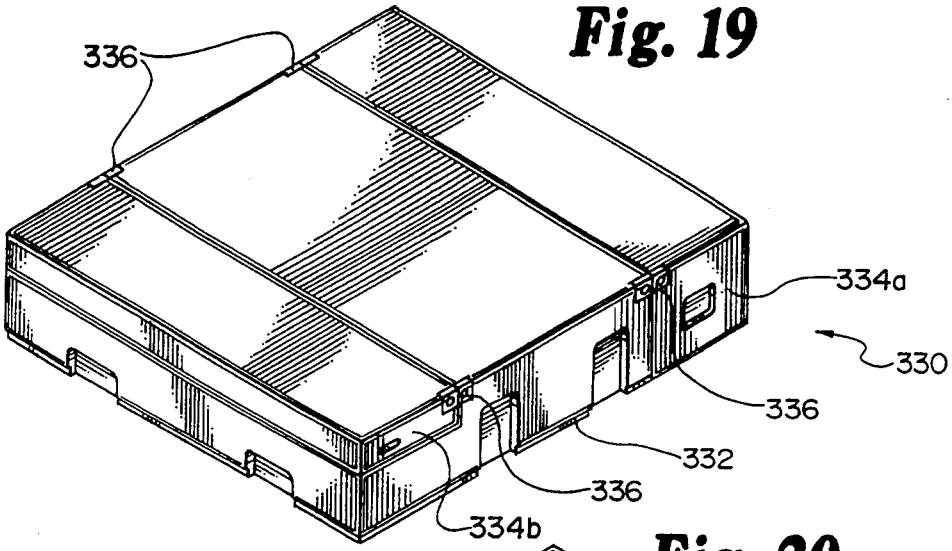
FIG. 19 is a front perspective view of the portable hinged riser unit of the present invention arranged in a single level platform configuration.
Figure 20:
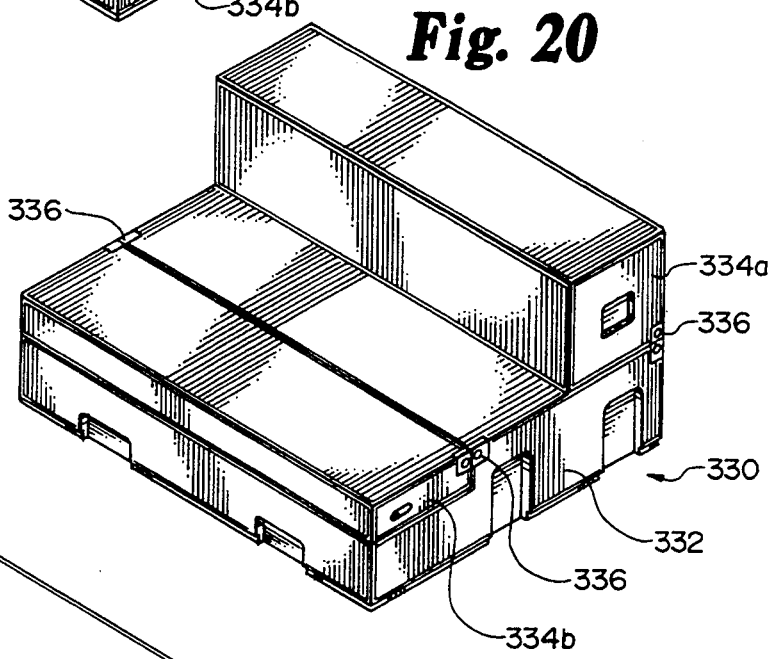
FIG. 20 is a front perspective view of the portable hinged riser unit of the present invention arranged in a two step, seated riser configuration.
Figure 21:
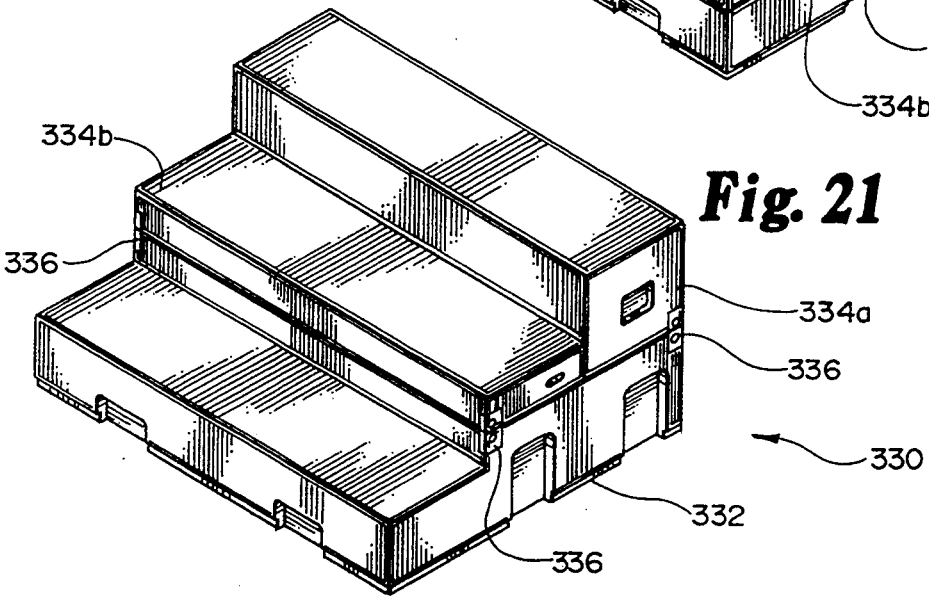
FIG. 21 is a front perspective view of the portable hinged riser unit of the present invention arranged in a three step configuration.
Figure 22:
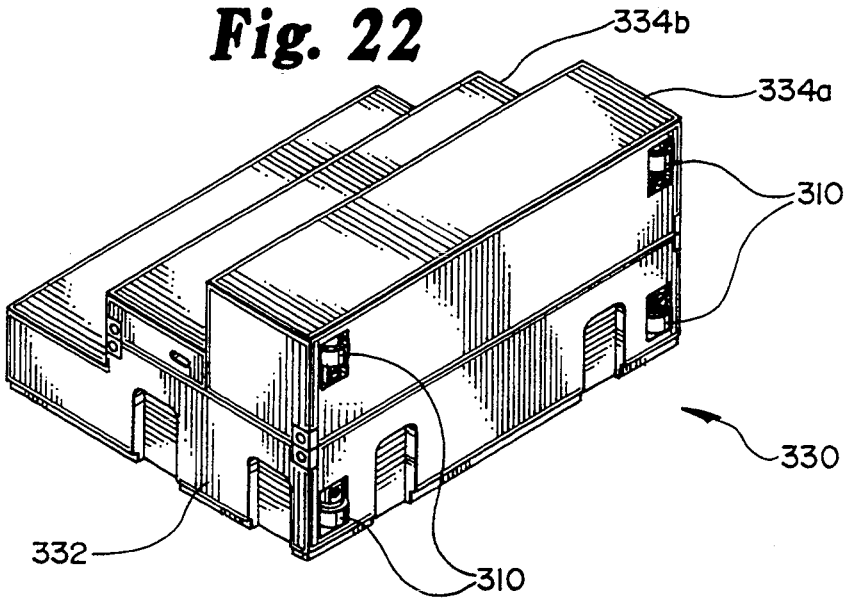
FIG. 22 is a rear perspective view of the portable hinged riser unit shown in FIG. 20.
Figure 23:
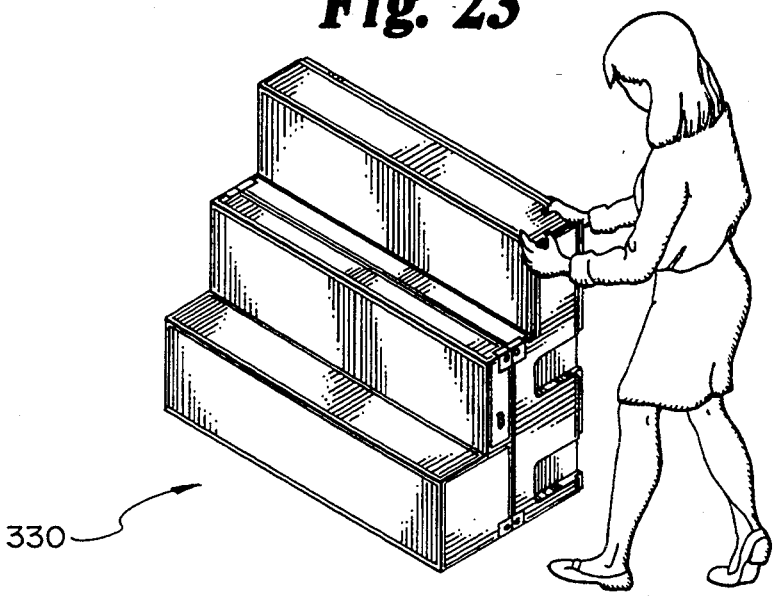
FIG. 23 is a front perspective view of the portable hinged riser unit shown in FIG. 21 in position on to be rolled by a person on the integral transport assembly.

The embodiment of a portable performance platform system in accordance with the present invention includes a hinged platform riser unit 330 capable of being foldable configured into a single level arrangement, a bi-level platform and seat arrangement, or a multi-level riser arrangement, as shown, for example in Figs. 19, 20, and 21, respectively. The hinged riser unit 330 that broadly includes a base 332, one or more generally rectangular step members 334, a plurality of hinge mechanisms 336 for pivotally, hingedly connecting the steps members to the base, and an integral transport assembly 310 in the form of two pair of wheels 314 mounted in the one of the side walls of the base member 330 and step members 334, as shown in FIG. 22. The horizontal orientation of the hinged riser unit 330 is shown in FIGS. 19–22, and the vertical orientation of the hinged riser unit 330 is shown in FIG. 23 such that the hinged riser unit may be rolled on the transport assembly 310 to a desired location.

The detailed description of the internal construction and operational features of the hinged platform riser unit 330, other than the operation of the transport assembly mechanism 310, is described in detail in the previously identified parent application, and is incorporated by reference herein. It will also be recognized that the type and positioning of the hinge mechanisms 336 differs from that described in the previously identified parent application in that the hinge mechanisms 336 in the preferred embodiment of the present invention are located at the corners of the adjacent pivoting edges of the base member 332 and the step members 334. In the preferred embodiment, the surface area of the base 333 of the platform riser unit 330 is approximately 48"×45", with the base 332 and an uppermost step member **334*a* each being approximately 12" high, with a lowermost step member 334*b*** being approximately 4" high.

Figure 24:
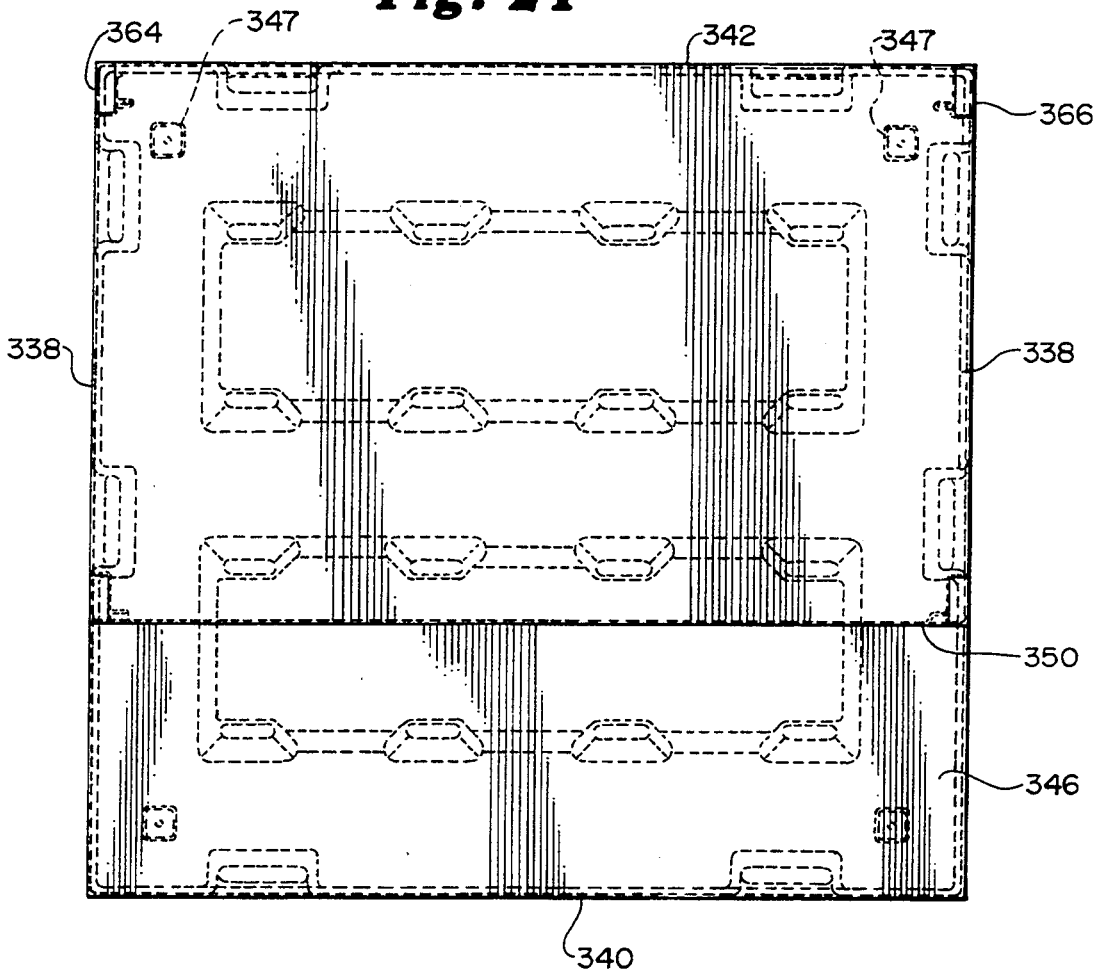
FIG. 24 is a top plan view of the base member of the portable hinged riser unit of the present invention.
Figure 25:
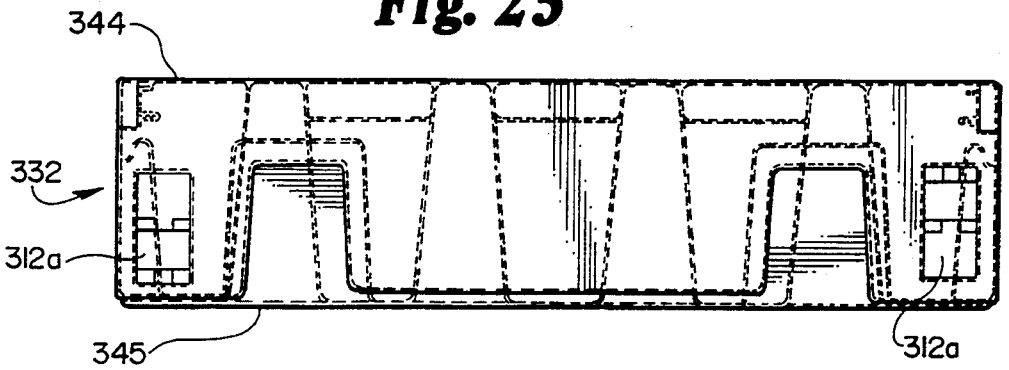
FIG. 25 is a rear elevational view of the base member shown in FIG. 24.

Referring to FIGS. 24 and 25, the base 332 has a substantially closed, polygonal, plane figure body with two opposed generally parallel side walls 338, a front wall 340, a rear wall 342 parallel to the front wall 340, a generally flat top support surface 344, and a bottom 345. A plurality of ground, stage or floor contacting feet 347 are connected to the bottom 345. The top surface 344 includes a lower level 346 and an upper level 348 in different, but parallel planes. A front facing midwall 350 extends generally perpendicularly between and connects the lower and upper levels 346, 348. All of the aforementioned walls, surfaces and levels are in substantially parallel or perpendicular relationship with respect to each other and those joined together are continuously and rigidly joined along straight intersecting edges.

Figure 29:
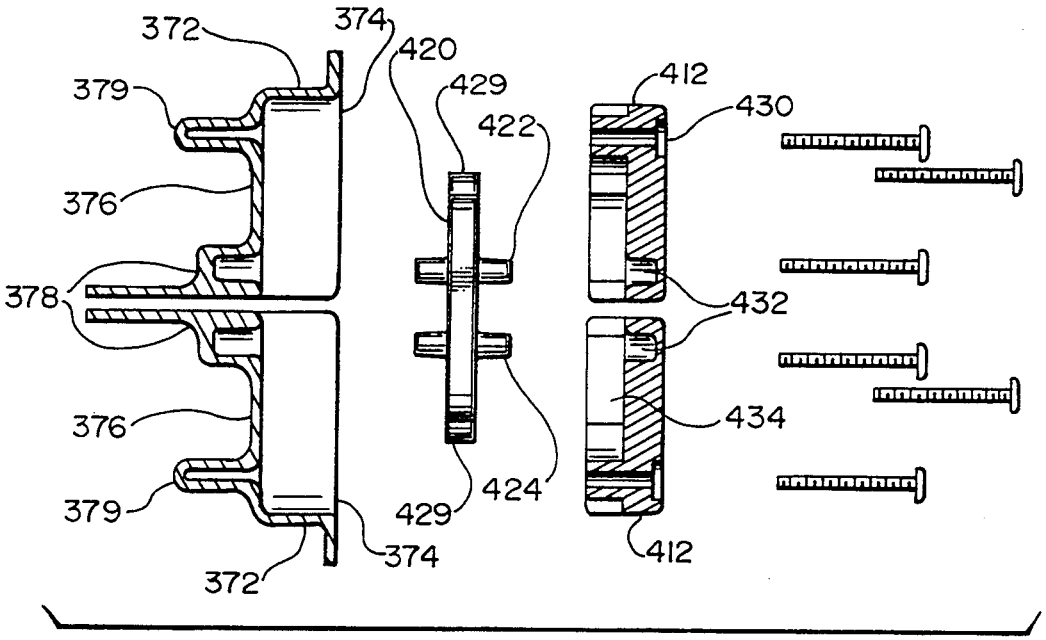
FIG. 29 is an exploded cross-sectional view of a hinge assembly.

In the preferred embodiment of the present invention, the hinge mechanisms 336 are mounted to the base member 332 in two pair of hinge wells, on pair of hinge wells for each step member 334. A first pair of hinge wells 364, 366 are positioned adjacent to and at the corners of the edge formed by the intersection of the outside surface of the upper level 348 and the rear wall 342 of the base. A second pair of hinge wells 368, 370 are positioned adjacent to and at the corners of the edge formed by the intersection of the midwall 350 and the outside surface of the upper level 348 of the base 332. Referring to FIG. 29, each hinge well 364, 366, 368, 370 in the base 332 has adjacent, perpendicular hinge well side walls 372, 374 and a hinge well floor 376. A hinge pin bore 378 and a plurality of hinge attachment bores 379 are formed in the hinge well floor 376.

Figure 26:
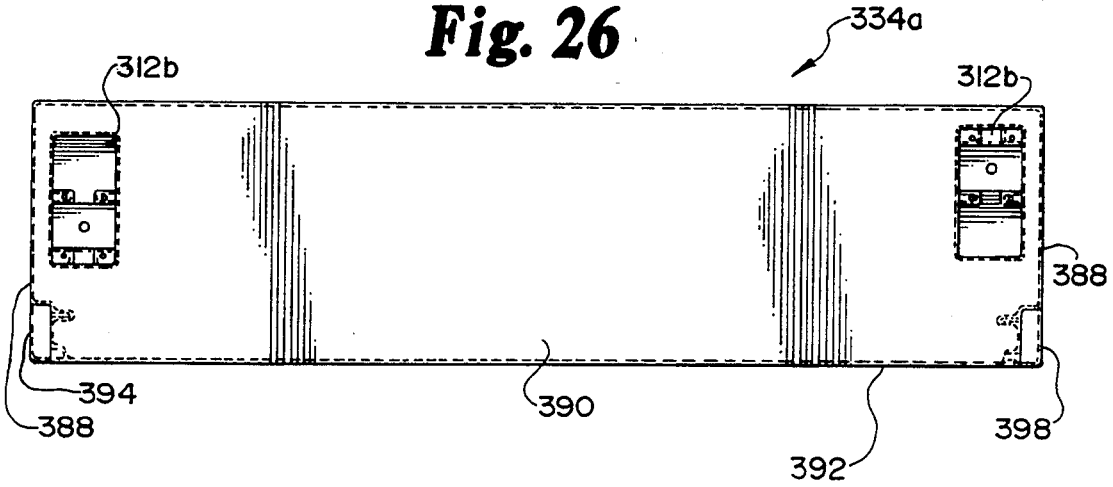
FIG. 26 is a rear elevational view of the topmost step member of the portable hinged riser unit of the present invention.
Figure 27:
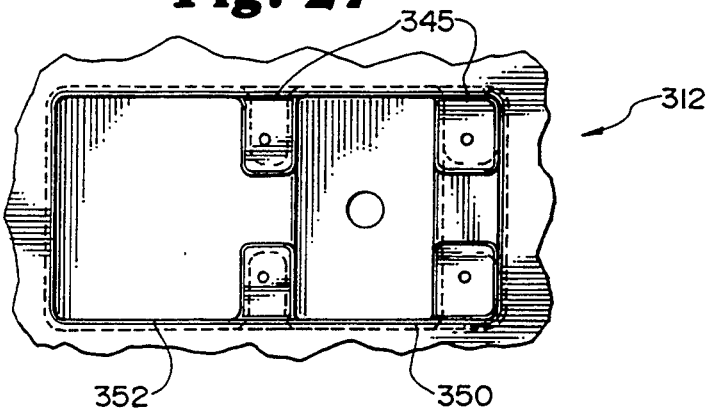
FIG. 27 is an exploded rear elevational view of one of the wheel cavities shown in FIG. 25 and 26.
Figure 28:
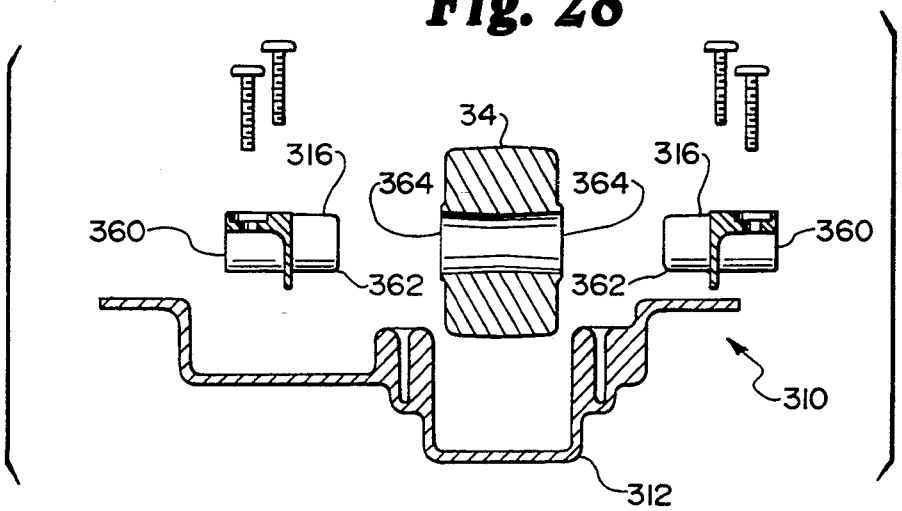
FIG. 28 is an exploded cross-sectional view of a wheel and bracket assembly mounted in the wheel cavity shown in FIG. 27.

Referring to FIG. 26, the rear wall 390 of the upper most step member **334*a* is shown. A pair of spaced hinge wells 394, 396 are positioned adjacent to and at the corners of the edge formed by the intersection of the side walls 388 and the top wall 392 of the high step 334*a*. The hinge wells 394, 396 compliment the hinge wells 364, 366 at the edge of the base 332 formed by the intersection of the upper surface of the upper level 348 and the rear wall 342**.

Figure 30:
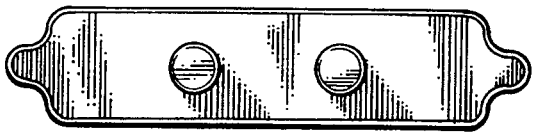
FIG. 30 is a top plan view of a hinge bar for the hinge assembly of FIG. 29.

The connecting hinge mechanisms 336 between the base member 332 and the uppermost step member **334*a* include the base hinge wells 364, 366 and the complimentary step member hinge wells 394, 396, and a plurality of hinge blocks 412 as shown in FIGS. 29 and 30. All of the hinge wells receive, or partially receive, substantially identical hinge blocks 412. Each hinge block 412 is a generally rectangular body that includes three hinge attachment holes 430 adapted to receive a screw or other fastening means, a hinge pin bore 432 that receives a corresponding one of a first pair of hinge pins 422, 424 of a hinge bar 420, and a hinge bar well 434 that receives a corresponding half of the hinge bar 420. The hinge bar 420 is adapted to be received with one of the hinge wells 364, 366. A corresponding second pair of hinge pins 426, 428 of the hinge bar 420 are received in the hinge bores 378 in the corresponding hinge well. The hinge pins 422, 424, 426, and 428 are parallel with respect to each other and extend perpendicular from the hinge bar 420 and into hinge pin bore mounts 378 formed in the base 332 and in the step members 334. Each pair of parallel hinge pins 422 and 426, and 424 and 428, provide an axis for rotation and movement of the hinge block 412 within the hinge wells, that effectively extends through the hinge block 412. A pair of rounded hinge tabs 429 on each end of the hinge bar 420 cooperate with corresponding walls in the hinge bar well 434 to allow for the pivotal movement of the hinge bar 420 with respect to the hinge blocks 412. The location and operation of the hinge wells 364, 366 and the hinge blocks 412 and hinge bar 420 provide a pivotal connection between the base member 332 and the step members 334 without presenting any mechanical parts along the intersecting edges that could catch or scrape a person standing or seated on the hinged riser unit 330**.

With reference now to FIGS. 25–28, the transport assemblies 310 will be described. In the preferred embodiment, each transport assembly 310 is comprised of a pair of wheel wells 312 formed at opposite ends of the rear wall of the base member 332 or step member 334, a wheel 314 for each wheel well 312 and a mounting mechanism 316 for mounting the wheel 314 in the wheel well 312 such that the axis of rotation of the wheel 314 is generally transverse to the platform surface of the base member 332 or step member 334. In the preferred embodiment, the wheel wells 312 comprise a wheel mount well 350, a slightly larger wheel receiving well 352 and four mounting mechanism posts 354. The wheel receiving well operates to accept the arcuate portion of the wheel 314 that extends beyond the peripheral edge of the platform surface of the base member 332 or step member 334*a* when the base member 332 and upper step member 334*a* are in an extended configuration with the rear wall of each adjacent and facing one another. In this way, the rear wall of the base member 332 and the upper step member 334*a* can be flush with each other. It will be seen that in the preferred embodiment, the wheel wells 312*a* of the base member 332, as shown in FIG. 25, are oriented in a mirror image relationship to the wheel wells 312*b* of the upper step member 334*a*, as shown in FIG. 26. The mounting mechanism 316 comprises a pair of angled brackets 360 having an axis pin 362 extending horizontally therefrom. Each angled bracket 360 is mounted onto two of the mounting mechanism posts 354 using screws or other similar fastening mechanisms. The axis pins 362 for the pair of angled brackets form the axis of rotation for the wheel 314 and extend partially into axis apertures 364 in each side of the wheel 314. Although the transport assemblies 310 have been described with respect to a pair of partially recessed wheel mounted in one of the side walls of the hinged riser unit 330, it will be recognized that other equivalent means for mounting and positioning the transport assemblies could be used and are intended to be within the scope of the present invention. For example, more than two wheels could be used for each transport assembly. The wheels could be positioned such that more than an arcuate portion of the wheel extended beyond the peripheral edge of the platform surface if, for example, the axis of rotation was also positioned beyond the peripheral edge of the platform surface.

Although the description of the preferred embodiment has been presented, it is contemplated that various changes, including those mentioned above, could be made without deviating from the spirit of the present invention. It is therefore desired that the present embodiment be considered in all respects as illustrative, not restrictive, and that reference be made to the appended claims rather than to foregoing description to indicate the scope of the invention.

What is claimed is:

1. A portable podium system designed for selective resting engagement on a ground surface adjacent to a performance area said podium system being selectively positionable between a transport orientation and a performance orientation, said podium system comprising:

two or more platform sections, each platform section having:

a platform member having a top surface and a bottom surface, said top surface being oriented generally perpendicular to said ground surface when said podium is positioned in the transport orientation and said top surface being oriented generally parallel to the ground surface when said podium is positioned in the performance orientation; and a support frame adapted for operable resting engagement with said ground surface operably coupled to and oriented to extend downwardly from the bottom surface of the platform member when said podium is oriented in said performance orientation, whereby the platform member presents a generally horizontal surface elevated above said ground surface when the podium is in the performance orientation;

means for operably connecting a platform section to one or more vertically adjacent platform sections so as to provide a multi-level elevated platform surface;

at least one of the platform section means having a transport assembly means operably coupled to said support frame, the transport assembly means including:

two or more wheels; and means for mounting each of the wheels on an axis of rotation that is generally perpendicular to the platform surface and positioned to allow at least an arcuate section of the wheels to extend beyond a peripheral edge of the support frame, whereby the wheels engage the ground surface when said podium is in the transport position and the wheels clear the ground surface when said podium is in the performance position.

2. The portable podium system of claim 1 further comprising railing means releasably connected to at least one of the side means.

3. The portable podium system of claim 1 further comprising side walls removably attached to the support frames.

4. The portable podium system of claim 1 further comprising a plurality of side walls fixedly attached to the support frames.

5. The portable podium system of claim 3 or 4 further wherein one of the side means contains an opening allowing one or more legs of a music stand to be slid under the platform surface.

6. The portable podium system of claim 1 wherein the floor of the first podium section is larger than the second podium section.

7. A portable podium designed for selective resting engagement on a ground surface adjacent to a performance area said podium being selectively positionable between a transport orientation and a performance orientation, said podium comprising:

a platform member having a top surface and a bottom surface, said top surface being oriented generally perpendicular to said ground surface when said podium is positioned in the transport orientation and said top surface being oriented generally parallel to the ground surface when said podium is positioned in the performance orientation;

a support frame adapted for operable resting engagement with said ground surface operably coupled to and oriented to extend downwardly from the bottom surface of the platform member when said podium is oriented in said performance orientation, whereby the platform member presents a generally horizontal surface elevated above said ground surface when the podium is in the performance orientation; and a transport assembly means operably coupled to said support frame, the transport assembly means including:

two or more wheels; and means for mounting each of the wheels on an axis of rotation that is generally perpendicular to the platform top surface and positioned to allow at least an arcuate section of the wheels to extend beyond a peripheral edge of the support frame, whereby the wheels engage the ground surface when said podium is in the transport position and the wheels clear the ground surface when said podium is in the performance position.

8. The portable podium of claim 7 wherein the platform member has a surface area of less than approximately 20 square feet and is elevated no more than approximately 2 feet above the ground surface.

9. The portable podium of claim 8 wherein the podium is designed to safely support an individual and has a load bearing capacity of less than approximately 200 pounds/square foot.

10. The portable podium of claim 9 wherein the podium weighs less than approximately 100 pounds.

11. The portable podium system of claim 1 wherein the means for operably connecting the platform sections comprises:

a clamp assembly having a clamp base and a clamp arm having a U-shaped clasp adapted to mate with a peripheral portion of the platform member of a lower one of the platform sections, the clamp base fixedly attached to an upper one of the platform sections and the clamp arm hingedly attached to the clamp base.

12. The portable podium of claim 7 further comprising railing means releasably connected to at least one of the side means.

13. The portable podium of claim 7 further comprising side walls removably attached to the support frames.

14. The portable podium of claim 7 further comprising a plurality of side walls fixedly attached to the support frames.

15. The portable podium of claim 13 or 14 further wherein one of the side means contains an opening allowing one or more legs of a music stand to be slid under the platform surface.

16. A portable performance platform system designed for selective resting engagement on a ground surface adjacent to a performance area, said performance platform system being selectively positionable between a transport orientation and a performance orientation, said platform system comprising:

a base riser unit having:

two adjacent parallel platform floor surfaces wherein the first floor surface is at a first height and the second floor surface is at a second height;

two or more side means fixedly connected approximately perpendicularly to the floor surfaces, the side means supporting the first floor surface at the first height and the second floor at the second height, the side means maintaining the floor surfaces in a horizontal orientation with respect to the ground surface; and a transport assembly means operably coupled to at least one of the side means, the transport assembly means including:

two or more wheels; and means for mounting each of the wheels on an axis of rotation that is generally perpendicular to the floor surfaces and positioned to allow at least an arcuate section of the wheels to extend beyond a peripheral edge of the floor surface, whereby the wheels engage the ground surface when said platform is in the transport position and the wheels clear the ground surface when said platform is in the performance position;

one or more generally rectangular step members, each step member having a pair of opposing platform surfaces and two or more side supports; and hinge means operably connected to the base riser and each step member for pivotally connecting the step members to the base riser to allow the floor surfaces of the base riser and the planar platform surfaces of the one or more step members to be selectively configured into one of a predetermined set of platform riser configurations.

17. The portable performance platform system of claim 16 wherein the step members include a lowermost step member and an uppermost step member, the uppermost step member further including a transport assembly means operably coupled to one of the side supports, the transport assembly means including:

at least one wheel; and means for mounting each of the wheels on an axis of rotation that is generally transverse to the platform surface and positioned to allow at least an arcuate section of the wheels to extend beyond a peripheral edge of the floor surface.

* * * * *

UNITED STATES PATENT AND TRADEMARK OFFICE

CERTIFICATE OF CORRECTION

PATENT NO. : 5,343,817

DATED : September 6 1994

INVENTOR(S) : Leslie R. Abraham et al.

It is certified that error appears in the above-indentified patent and that said Letters Patent is hereby corrected as shown below:

Column 1, line 9, delete the word "State" and substitute therefor --States--.

Column 1, line 53, delete the word "al," and substitute therefor --al.,--.

Column 2, line 8, delete the word "al." and substitute therefor --al.,--.

Column 2, line 31, delete the word "el" and substitute therefor --et--.

Column 5, line 20, delete the word "in" and substitute therefor --an--.

Column 6, line 26, delete the word "slid" and substitute therefor --slide--.

Column 7, line 25, delete the word "on".

Column 10, line 34, delete the word "ears," and substitute therefor --ears.--.

UNITED STATES PATENT AND TRADEMARK OFFICE

CERTIFICATE OF CORRECTION

PATENT NO. : 5,343,817
DATED : September 6, 1994
INVENTOR(S) : Leslie R. Abraham et al.

It is certified that error appears in the above-indentified patent and that said Letters Patent is hereby corrected as shown below:

Column 14, line 20, delete the period after the number "22".

Column 14, line 21, insert a period after the number "10)".

Column 15, line 47, delete the word "Figs." and substitute therefor --FIGS.--.

Column 16, line 5, delete the number "333" and substitute therefor --332--.

Column 17, line 53, delete the word "wheel" and substitute therefor --wheels--.

Column 18, line 8, insert a comma after the word "area".

Column 18, line 66, insert a comma after the word "area".

Signed and Sealed this

Eighteenth Day of April, 1995

Bruce Lehman

*Attest:*

BRUCE LEHMAN

*Commissioner of Patents and Trademarks*

*Attesting Officer*

UNITED STATES PATENT AND TRADEMARK OFFICE

CERTIFICATE OF CORRECTION

PATENT NO. : 5,343,817
DATED : September 6, 1994
INVENTOR(S) : Abraham et al.

It is certified that error appears in the above-indentified patent and that said Letters Patent is hereby corrected as shown below:

Column 14, line 7, delete the words "front side 38" and substitute therefor -- back side 40 --.

Signed and Sealed this

Twelfth Day of November, 1996

*Attest:*

Bruce Lehman

BRUCE LEHMAN

*Attesting Officer*

*Commissioner of Patents and Trademarks*